US009249649B2

(12) United States Patent
Fripp et al.

(10) Patent No.: US 9,249,649 B2
(45) Date of Patent: Feb. 2, 2016

(54) BIDIRECTIONAL DOWNHOLE FLUID FLOW CONTROL SYSTEM AND METHOD

(75) Inventors: Michael Linley Fripp, Carrollton, TX (US); Jason D. Dykstra, Carrollton, TX (US); Orlando DeJesus, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 53 days.

(21) Appl. No.: 13/594,790

(22) Filed: Aug. 25, 2012

(65) Prior Publication Data

US 2013/0140038 A1 Jun. 6, 2013

(30) Foreign Application Priority Data

Dec. 6, 2011 (WO) ..... PCT/US2011/06358

(51) Int. Cl.
*E21B 43/24* (2006.01)
*E21B 34/08* (2006.01)
*E21B 43/12* (2006.01)

(52) U.S. Cl.
CPC ..... *E21B 34/08* (2013.01); *E21B 43/12* (2013.01)

(58) Field of Classification Search
USPC ..... 166/222, 243, 263, 303, 305.1, 316, 166/369; 137/599.01, 601.18, 809, 814
See application file for complete search history.

(56) References Cited

U.S. PATENT DOCUMENTS 1,329,559 A * 2/1920 Tesla ..... 138/37
3,354,958 A * 11/1967 Parker ..... 166/303
3,461,897 A * 8/1969 Kwok ..... 137/809
4,127,170 A * 11/1978 Redford ..... 166/252.1
4,782,896 A 11/1988 Witten
7,290,606 B2 * 11/2007 Coronado et al. ..... 166/250.15
7,419,002 B2 * 9/2008 Dybevik et al. ..... 166/205
7,861,770 B2 * 1/2011 Ascanio Milano et al. ..... 166/57
2005/0150657 A1 * 7/2005 Howard et al. ..... 166/303
2007/0169942 A1 7/2007 Loretz et al.
2007/0246213 A1 * 10/2007 Hailey, Jr. ..... 166/278
2009/0095484 A1 * 4/2009 Huang et al. ..... 166/319
2009/0266555 A1 10/2009 May et al.
2011/0042092 A1 * 2/2011 Fripp et al. ..... 166/319
2011/0139453 A1 6/2011 Schultz et al.
2011/0186300 A1 * 8/2011 Dykstra et al. ..... 166/316
2011/0240284 A1 * 10/2011 Hamid et al. ..... 166/185
2011/0297384 A1 * 12/2011 Fripp et al. ..... 166/316
2011/0297385 A1 * 12/2011 Dykstra et al. ..... 166/316
2011/0308806 A9 * 12/2011 Dykstra et al. ..... 166/316
2012/0060624 A1 * 3/2012 Dykstra ..... 73/861.22

OTHER PUBLICATIONS

International Search Report and Written Opinion, KIPO, PCT/US2011/063582 (Aug. 17, 2012).

* cited by examiner

*Primary Examiner* — Blake Michener

(57) ABSTRACT

A bidirectional downhole fluid flow control system is operable to control the inflow of formation fluids and the outflow of injection fluids. The system includes at least one injection flow control component and at least one production flow control component in parallel with the at least one injection flow control component. The at least one injection flow control component and the at least one production flow control component each have direction dependent flow resistance, such that injection fluid flow experiences a greater flow resistance through the at least one production flow control component than through the at least one injection flow control component and such that production fluid flow experiences a greater flow resistance through the at least one injection flow control component than through the at least one production flow control component.

9 Claims, 9 Drawing Sheets

180
186
190
182
188
184
192
194

180
190
182
188
184
196
192
194

200
206
210
202
208
204
214

200
210
202
208
204
212
214

BIDIRECTIONAL DOWNHOLE FLUID FLOW CONTROL SYSTEM AND METHOD

CROSS-REFERENCE TO RELATED APPLICATIONS

This application claims the benefit under 35 U.S.C. §119 of the filing date of International Application No. PCT/US2011/063582, filed Dec. 6, 2011. The entire disclosure of this prior application is incorporated herein by this reference.

TECHNICAL FIELD OF THE INVENTION

This invention relates, in general, to equipment utilized in conjunction with operations performed in subterranean wells and, in particular, to a downhole fluid flow control system and method that are operable to control the inflow of formation fluids and the outflow of injection fluids.

BACKGROUND OF THE INVENTION

Without limiting the scope of the present invention, its background will be described with reference to steam injection into a hydrocarbon bearing subterranean formation, as an example. During the production of heavy oil, oil with high viscosity and high specific gravity, it is sometimes desirable to inject a recovery enhancement fluid into the reservoir to improve oil mobility. One type of recovery enhancement fluid is steam that may be injected using a cyclic steam injection process, which is commonly referred to as a "huff and puff" operation. In such a cyclic steam stimulation operation, a well is put through cycles of steam injection, soak and oil production. In the first stage, high temperature steam is injected into the reservoir. In the second stage, the well is shut to allow for heat distribution in the reservoir to thin the oil. During the third stage, the thinned oil is produced into the well and may be pumped to the surface. This process may be repeated as required during the productive lifespan of the well.

In wells having multiple zones, due to differences in the pressure and/or permeability of the zones as well as pressure and thermal losses in the tubular string, the amount of steam entering each zone may be difficult to control. One way to assure the desired steam injection at each zone is to establish a critical flow regime through nozzles associated with each zone. Critical flow of a compressible fluid through a nozzle is achieved when the velocity through the throat of the nozzle is equal to the sound speed of the fluid at local fluid conditions. Once sonic velocity is reached, the velocity and therefore the flow rate of the fluid through the nozzle cannot increase regardless of changes in downstream conditions. Accordingly, regardless of the differences in annular pressure at each zone, as long as critical flow is maintained at each nozzle, the amount of steam entering each zone is known.

It has been found, however, that achieving the desired injection flowrate and pressure profile by reverse flow through conventional flow control devices is impracticable. As the flow control components are designed for production flowrates, attempting to reverse flow through conventional flow control components at injection flowrates causes an unacceptable pressure drop. Accordingly, a need has arisen for a fluid flow control system that is operable to control the inflow of fluids for production from the formation. A need has also arisen for such a fluid flow control system that is operable to control the outflow of fluids from the completion string into the formation at the desired injection flowrate. Further, a need has arisen for such a fluid flow control system that is operable to allow repeated cycles of inflow of formation fluids and outflow of injection fluids.

SUMMARY OF THE INVENTION

The present invention disclosed herein comprises a downhole fluid flow control system and method for controlling the inflow of fluids for production from the formation. In addition, the downhole fluid flow control system and method of the present invention are operable to control the outflow of fluids from the completion string into the formation at the desired injection flowrate. Further, the downhole fluid flow control system and method of the present invention are operable to allow repeated cycles of inflow of formation fluids and outflow of injection fluids.

In one aspect, the present invention is directed to a bidirectional downhole fluid flow control system. The system includes at least one injection flow control component and at least one production flow control component, in parallel with the at least one injection flow control component. The at least one injection flow control component and the at least one production flow control component each have direction dependent flow resistance such that injection fluid flow experiences a greater flow resistance through the at least one production flow control component than through the at least one injection flow control component and such that production fluid flow experiences a greater flow resistance through the at least one injection flow control component than through the at least one production flow control component.

In one embodiment, the at least one injection flow control component may be a fluidic diode providing greater resistance to flow in the production direction than in the injection direction. In this embodiment, the fluidic diode may be a vortex diode wherein injection fluid flow entering the vortex diode travels primarily in a radial direction and wherein production fluid flow entering the vortex diode travels primarily in a tangential direction. In another embodiment, the at least one production flow control component may be a fluidic diode providing greater resistance to flow in the injection direction than in the production direction. In this embodiment, the fluidic diode may be a vortex diode wherein production fluid flow entering the vortex diode travels primarily in a radial direction and wherein injection fluid flow entering the vortex diode travels primarily in a tangential direction.

In one embodiment, the at least one injection flow control component may be a fluidic diode providing greater resistance to flow in the production direction than in the injection direction in series with a nozzle having a throat portion and a diffuser portion operable to enable critical flow therethrough. In other embodiments, the at least one injection flow control component may be a fluidic diode providing greater resistance to flow in the production direction than in the injection direction in series with a fluid selector valve. In certain embodiments, the at least one production flow control component may be a fluidic diode providing greater resistance to flow in the injection direction than in the production direction in series with an inflow control device.

In another aspect, the present invention is directed to a bidirectional downhole fluid flow control system. The system includes at least one injection vortex diode and at least one production vortex diode. In this configuration, injection fluid flow entering the injection vortex diode travels primarily in a radial direction while production fluid flow entering the injection vortex diode travels primarily in a tangential direction. Likewise, production fluid flow entering the production vortex diode travels primarily in a radial direction while injection fluid flow entering the production vortex diode travels primarily in a tangential direction.

In one embodiment, the at least one injection vortex diode may be in series with a nozzle having a throat portion and a diffuser portion operable to enable critical flow therethrough. In another embodiment, the at least one injection vortex diode may be in series with a fluid selector valve. In a further embodiment, the at least one production vortex diode may be in series with an inflow control device. In certain embodiments, the at least one injection vortex diode may be a plurality of injection vortex diodes in parallel with each other. In other embodiments, the at least one production vortex diode may be a plurality of production vortex diodes in parallel with each other.

In a further aspect, the present invention is directed to a bidirectional downhole fluid flow control method. The method includes providing a fluid flow control system at a target location downhole, the fluid flow control system having at least one injection flow control component and at least one production flow control component in parallel with the at least one injection flow control component; pumping an injection fluid from the surface into a formation through the fluid flow control system such that the injection fluid experiencing greater flow resistance through the production flow control component than through the injection flow control component; and producing a formation fluid to the surface through the fluid flow control system such that the production fluid experiencing greater flow resistance through the injection flow control component than through the production flow control component. The method may also include pumping the injection fluid through parallel opposing fluid diodes, each having direction dependent flow resistance, producing the formation fluid through parallel opposing fluid diodes, each having direction dependent flow resistance, pumping the injection fluid through parallel opposing vortex diodes, each having direction dependent flow resistance, producing the formation fluid through parallel opposing vortex diodes, each having direction dependent flow resistance or pumping the injection fluid through an injection fluid diode having direction dependent flow resistance and a nozzle in series with the fluid diode, the nozzle having a throat portion and a diffuser portion operable to enable critical flow therethrough.

In an additional aspect, the present invention is directed to a bidirectional downhole fluid flow control system. The system includes at least one injection flow control component and at least one production flow control component, in parallel with the at least one injection flow control component. The at least one injection flow control component has direction dependent flow resistance such that inflow of production fluid experiences a greater flow resistance through the at least one injection flow control component than outflow of injection fluid through the at least one injection flow control component.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
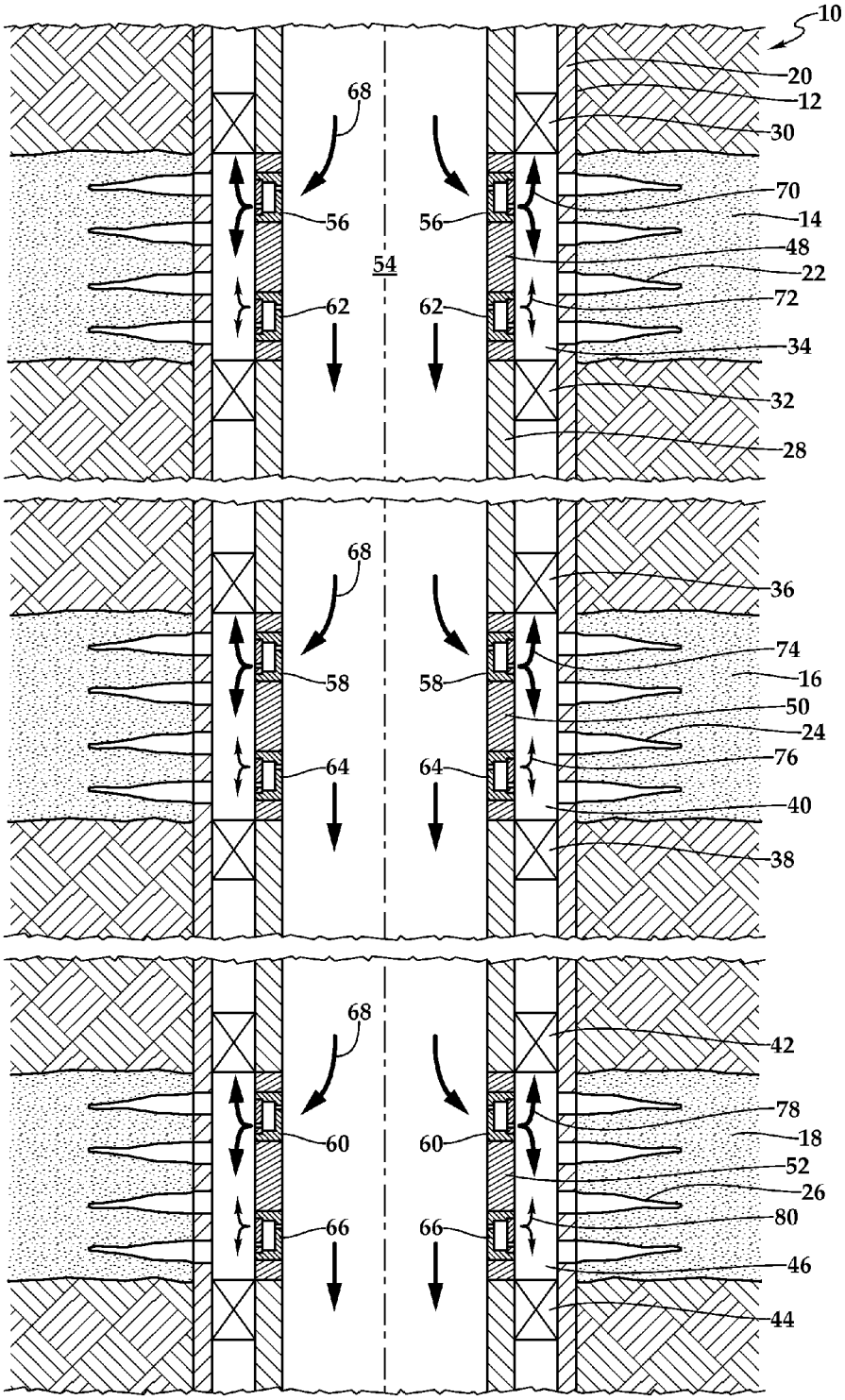
FIG. 1 is a schematic illustration of a well system operating a plurality of downhole fluid flow control systems according to an embodiment of the present invention during an injection phase of well operations.

Referring initially to FIG. 1, a well system including a plurality of bidirectional downhole fluid flow control systems positioned in a downhole tubular string is schematically illustrated and generally designated 10. A wellbore 12 extends through the various earth strata including formations 14, 16, 18. Wellbore 12 includes casing 20 that may be cemented within wellbore 12. Casing 20 is perforated at each zone of interest corresponding to formations 14, 16, 18 at perforations 22, 24, 26. Disposed with casing 20 and forming a generally annular area therewith is a tubing string 28 that includes a plurality of tools such as packers 30, 32 that isolate annulus 34, packers 36, 38 that isolate annulus 40 and packers 42, 44 that isolate annulus 46. Tubing string 28 also includes a plurality of bidirectional downhole fluid flow control systems 48, 50, 52 that are respectively positioned relative to annuluses 34, 40, 46. Tubing string 28 defines a central passageway 54.

In the illustrated embodiment, fluid flow control system 48 has a plurality of injection flow control components 56, fluid flow control system 50 has a plurality of injection flow control components 58 and fluid flow control system 52 has a plurality of injection flow control components 60. In addition, fluid flow control system 48 has a plurality of production flow control components 62, fluid flow control system 50 has a plurality of production flow control components 64 and fluid flow control system 52 has a plurality of production flow control components 66. Flow control components 56, 62 provide a plurality of flow paths between central passageway 54 and annulus 34 that are in parallel with one another. Flow control components 58, 64 provide a plurality of flow paths between central passageway 54 and annulus 40 that are in parallel with one another. Flow control components 60, 66 provide a plurality of flow paths between central passageway 54 and annulus 46 that are in parallel with one another. Each of flow control components 56, 58, 60, 62, 64, 66 includes at least one flow control element, such as a fluid diode, having direction dependent flow resistance.

Figure 2:
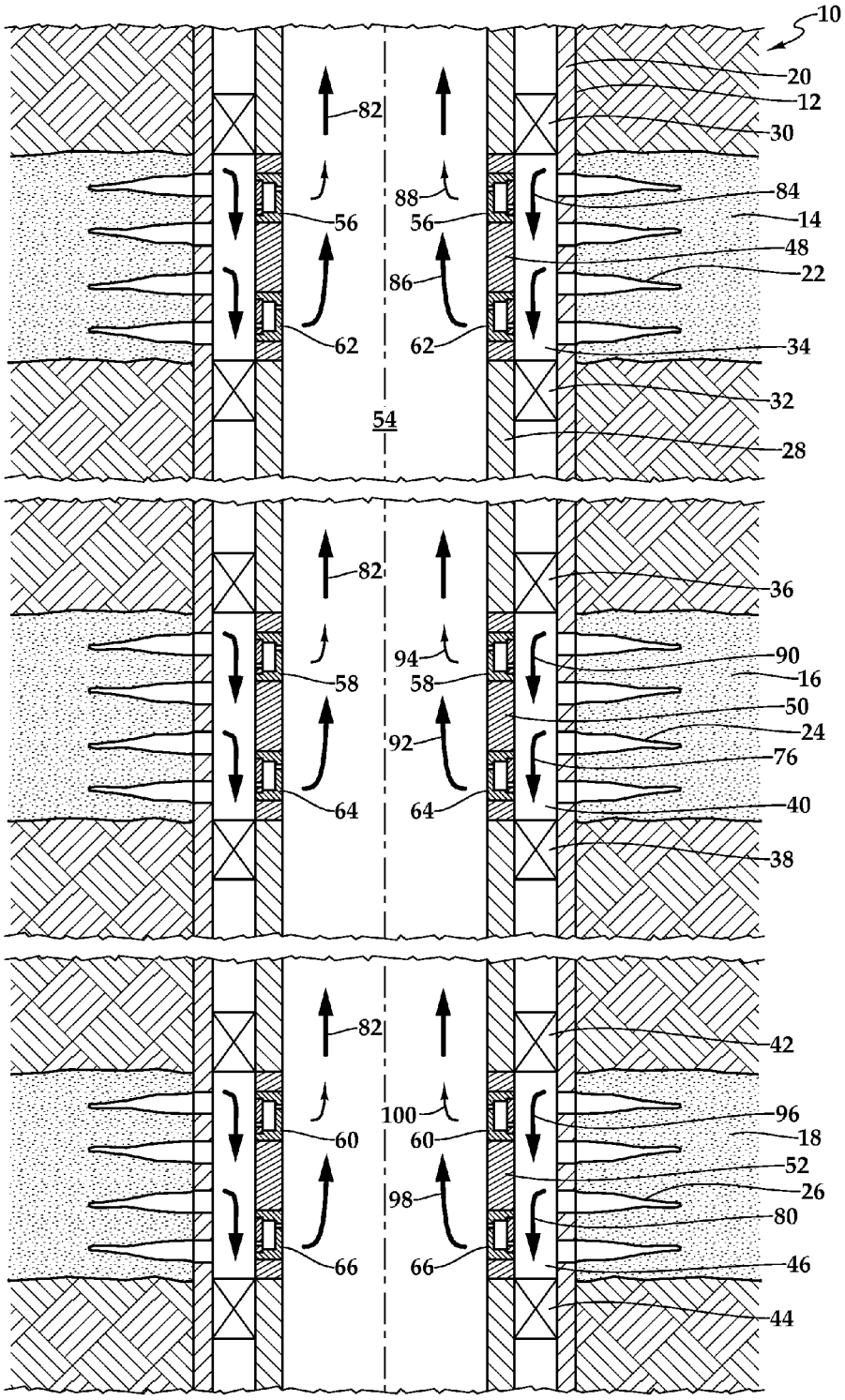
FIG. 2 is a schematic illustration of a well system operating a plurality of downhole fluid flow control systems according to an embodiment of the present invention during a production phase of well operations.

In this configuration, each fluid flow control system 48, 50, 52 may be used to control the injection rate of a fluid into its corresponding formation 14, 16, 18 and the production rate of fluids from its corresponding formation 14, 16, 18. For example, during a cyclic steam stimulation operation, steam may be injected into formations 14, 16, 18 as indicated by arrows 68 in central passageway 54, large arrows 70 and small arrows 72 in annulus 34, large arrows 74 and small arrows 76 in annulus 40, and large arrows 78 and small arrows 80 in annulus 46, as best seen in FIG. 1. When the steam injection phase of the cyclic steam stimulation operation is complete, well system 10 may be shut in to allow for heat distribution in formations 14, 16, 18 to thin the oil. After the soaking phase of the cyclic steam stimulation operation, well system 10 may be opened to allow reservoir fluids to be produced into the well from formations 14, 16, 18 as indicated by arrows 82 in central passageway 54, arrows 84 in annulus 34, large arrows 86 and small arrows 88 in fluid flow control system 48, arrows 90 in annulus 40, large arrows 92 and small arrows 94 in fluid flow control system 50 and arrows 96 in annulus 46, large arrows 98 and small arrows 100 in fluid flow control system 52, as best seen in FIG. 2. After the production phase of the cyclic steam stimulation operation, the phases of the cyclic steam stimulation operation may be repeated as necessary.

As stated above, each of flow control components 56, 58, 60, 62, 64, 66 includes at least one flow control element having direction dependent flow resistance. This direction dependent flow resistance determines the volume or relative volume of fluid that is capable of flowing through a particular flow control component. In the fluid injection operation depicted in FIG. 1, the relative fluid injection volumes are indicated as large arrows 70, 74, 78 representing injection through flow control components 56, 58, 60, respectively and small arrows 72, 76, 80 representing injection through flow control components 62, 64, 66, respectively. Likewise, in the fluid production operation depicted in FIG. 2, the relative fluid production volumes are indicated as large arrows 86, 92, 98 representing production through flow control components 62, 64, 66, respectively and small arrows 88, 94, 100 representing production through flow control components 56, 58, 60, respectively. In the illustrated embodiment, injection fluid flow experiences a greater flow resistance through flow control components 62, 64, 66 than through flow control components 56, 58, 60 while production fluid flow experiences a greater flow resistance through flow control components 56, 58, 60 than through flow control components 62, 64, 66. In this configuration, flow control components 62, 64, 66 may be referred to as production flow control components as a majority of the production flow passes therethrough and flow control components 56, 58, 60 may be referred to as injection flow control components as a majority of the injection flow passes therethrough.

Even though FIGS. 1 and 2 depict the present invention in a vertical section of the wellbore, it should be understood by those skilled in the art that the present invention is equally well suited for use in wells having other directional configurations including horizontal wells, deviated wells, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Also, even though FIGS. 1 and 2 depict a particular number of fluid flow control systems with each zone, it should be understood by those skilled in the art that any number of fluid flow control systems may be associated with each zone including having different numbers of fluid flow control systems associated with different zones. Further, even though FIGS. 1 and 2 depict the fluid flow control systems as having flow control capabilities, it should be understood by those skilled in the art that fluid flow control systems could have additional capabilities such as sand control. In addition, even though FIGS. 1 and 2 depict the fluid flow control systems as having a particular configuration of production flow control components and injection flow control components, it should be understood by those skilled in the art that fluid flow control systems having other configurations of production flow control components and injection flow control components are possible and are considered within the scope of the present invention. For example, the production flow control components may be positioned uphole of the injection flow control components. There may be a greater or lesser number of production flow control components than injection flow control components. Certain or all of the production flow control components may be positioned about the same circumferential location as certain or all of the injection flow control components. Some of the production flow control components may be positioned about a different circumferential location than other of the production flow components. Likewise, some of the injection flow control components may be positioned about a different circumferential location than other of the injection flow components.

Figure 3A:
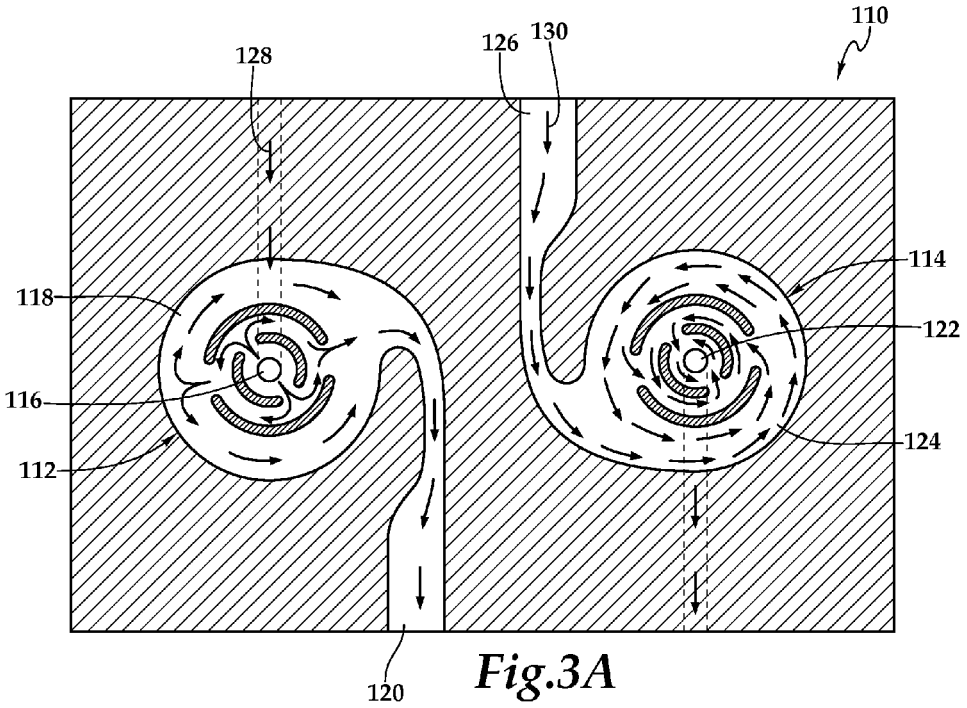
FIGS. 3A-3B are schematic illustrations of flow control components having directional dependent flow resistance for use in a fluid flow control system according to an embodiment of the present invention.
Figure 3B:
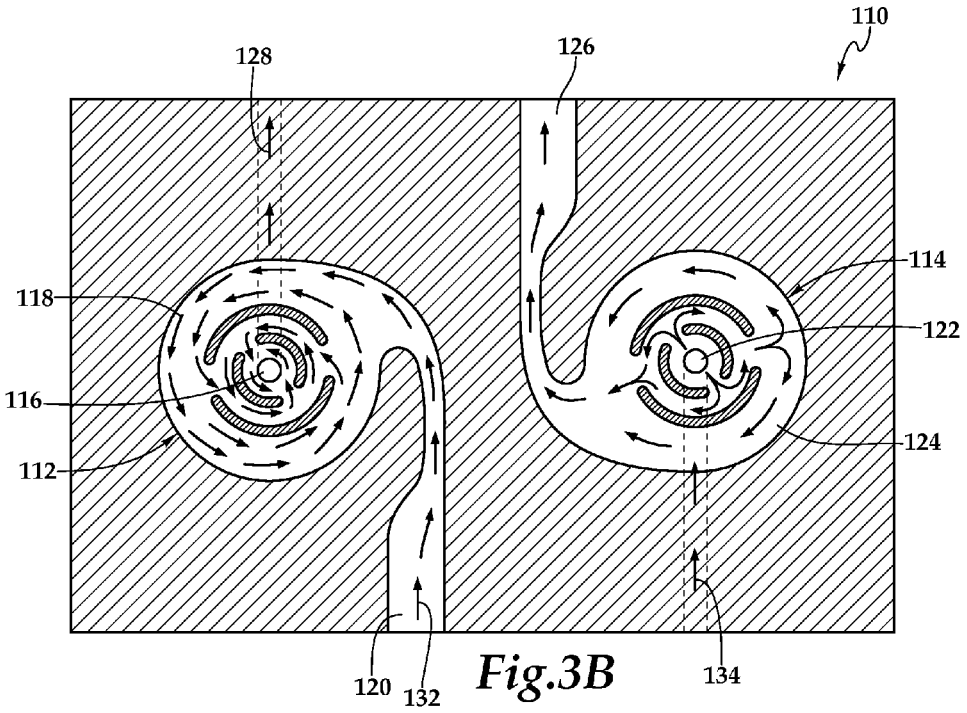

Referring next to FIGS. 3A-3B, therein is depicted a portion of a fluid flow control system having flow control components with directional dependent flow resistance, during injection and production operations, respectively, that is generally designated 110. In the illustrated section, two opposing flow control components 112, 114 are depicted wherein flow control component 112 is an injection flow control component and flow control component 114 is a production flow control component. As illustrated, flow control component 112 is a fluid diode in the form of a vortex diode having a central port 116, a vortex chamber 118 and a lateral port 120. Likewise, flow control component 114 is a fluid diode in the form of a vortex diode having a central port 122, a vortex chamber 124 and a lateral port 126.

FIG. 3A represents an injection phase of well operations. Injection flow is depicted as arrows 128 in flow control component 112 and as arrows 130 in flow control component 114. As illustrated, injection fluid 130 entering flow control component 114 at lateral port 126 is directed into vortex chamber 124 primarily in a tangentially direction which causes the fluid to spiral around vortex chamber 124, as indicted by the arrows, before eventually exiting through central port 122. Fluid spiraling around vortex chamber 124 suffers from frictional losses. Further, the tangential velocity produces centrifugal force that impedes radial flow. Consequently, injection fluid passing through flow control component 114 that enters vortex chamber 124 primarily tangentially encounters significant resistance which results in a significant reduction in the injection flowrate therethrough.

At the same time, injection fluid 128 entering vortex chamber 118 from central port 116 primarily travels in a radial direction within vortex chamber 118, as indicted by the arrows, before exiting through lateral port 120 with little spiraling within vortex chamber 116 and without experiencing the associated frictional and centrifugal losses. Consequently, injection fluid passing through flow control component 112 that enters vortex chamber 118 primarily radially encounters little resistance and passes therethrough relatively unimpeded enabling a much higher injection flowrate as compared to the injection flowrate through flow control component 114.

FIG. 3B represents a production phase of well operations. Production flow is depicted as arrows 132 in flow control component 112 and as arrows 134 in flow control component 114. As illustrated, production fluid 132 entering flow control component 112 at lateral port 120 is directed into vortex chamber 118 primarily in a tangentially direction which causes the fluid to spiral around vortex chamber 118, as indicted by the arrows, before eventually exiting through central port 116. Fluid spiraling around vortex chamber 118 suffers from frictional and centrifugal losses. Consequently, production fluid passing through flow control component 112 that enters vortex chamber 118 primarily tangentially encounters significant resistance which results in a significant reduction in the production flowrate therethrough.

At the same time, production fluid 134 entering vortex chamber 124 from central port 122 primarily travels in a radial direction within vortex chamber 124, as indicted by the arrows, before exiting through lateral port 126 with little spiraling within vortex chamber 124 and without experiencing the associated frictional and centrifugal losses. Consequently, production fluid passing through flow control component 114 that enters vortex chamber 124 primarily radially encounters little resistance and passes therethrough relatively unimpeded enabling a much higher production flowrate as compared to the production flowrate through flow control component 112.

Even though flow control components 112, 114 have been described and depicted with a particular design, those skilled in the art will recognize that the design of the flow control components will be determined based upon factors such as the desired flowrate, the desired pressure drop, the type and composition of the injection and production fluids and the like. For example, when the fluid flow resisting element within a flow control component is a vortex chamber, the relative size, number and approach angle of the inlets can be altered to direct fluids into the vortex chamber to increase or decrease the spiral effects, thereby increasing or decreasing the resistance to flow and providing a desired flow pattern in the vortex chamber. In addition, the vortex chamber can include flow vanes or other directional devices, such as grooves, ridges, waves or other surface shaping, to direct fluid flow within the chamber or to provide different or additional flow resistance. It should be noted by those skilled in the art that even though the vortex chambers can be cylindrical, as shown, flow control components of the present invention could have vortex chambers having alternate shapes including, but not limited to, right rectangular, oval, spherical, spheroid and the like. As such, it should be understood by those skilled in the art that the particular design and number of injection flow control components will be based upon the desired injection profile with the production flow control components contributing little to the overall injection flowrate while the particular design and number of production flow control components will be based upon the desired production profile with the injection flow control components contributing little to the overall production flowrate.

As illustrated in FIGS. 3A-3B, use of flow control components 112, 114 enables both production fluid flow control and injection fluid flow control. In the illustrated examples, flow control component 114 provides a greater resistance to fluid flow than flow control component 112 during the injection phase of well operations while flow control component 112 provide a greater resistance to fluid flow than flow control component 114 during the production phase of well operations. Unlike complicated and expensive prior art systems that required one set of flow control components for production and another set flow control components for injection along with the associated check valves to prevent reverse flow, the present invention is able to achieve the desired flow and pressure regimes for both the production direction and the injection direction utilizing solid state flow control components operable for bidirectional flow with direction dependent flow resistance.

Figure 4A:
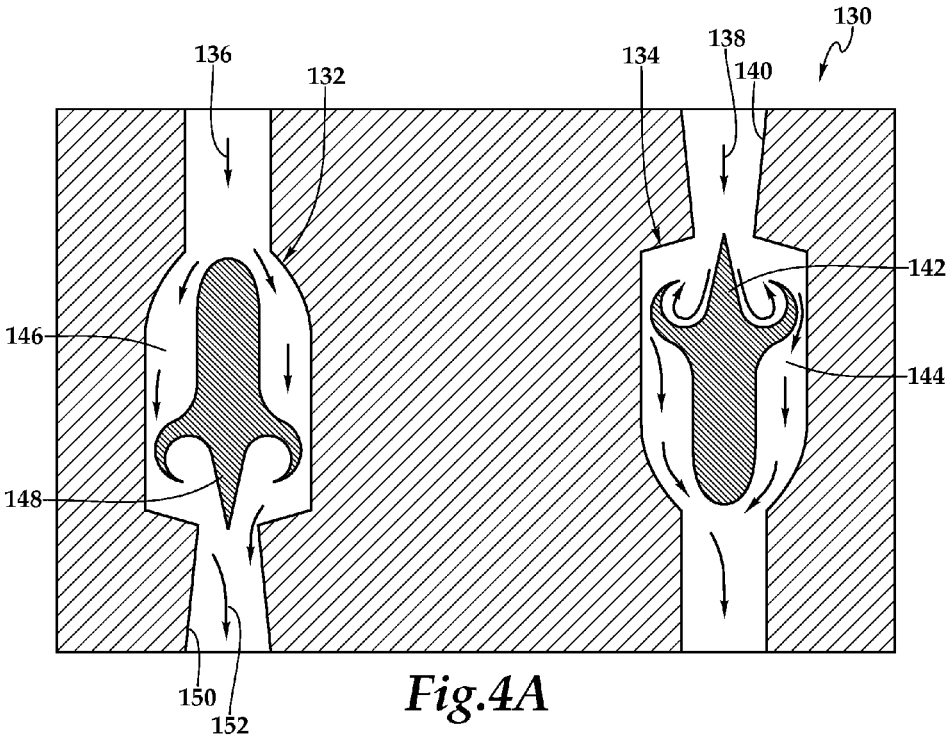
FIGS. 4A-4B are schematic illustrations of flow control components having directional dependent flow resistance for use in a fluid flow control system according to an embodiment of the present invention.
Figure 4B:
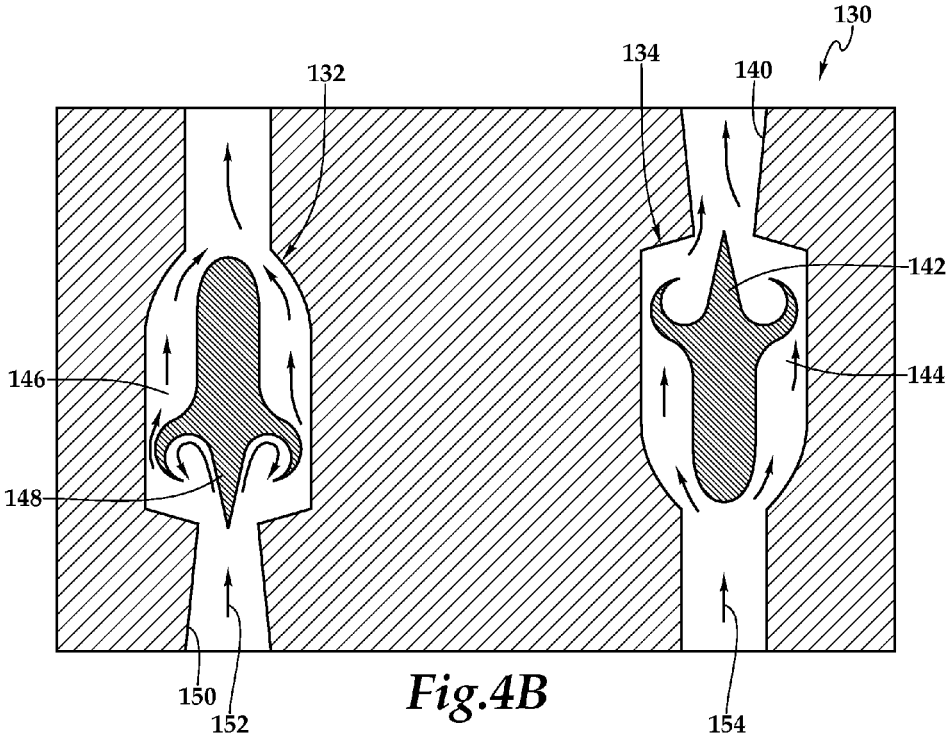

Even though flow control components 112, 114 have been described and depicted as having fluid diodes in the form of vortex diodes, it should be understood by those skilled in the art that flow control components of the present invention could have other types of fluid diodes that create direction dependent flow resistance. For example, as depicted in FIGS. 4A-4B, a fluid flow control system 130 has two opposing flow control components 132, 134 having fluid diodes in the form of scroll diodes that provide direction dependent flow resistance. In the illustrated embodiment, flow control component 132 is an injection flow control component and flow control component 134 is a production flow control component.

FIG. 4A represents an injection phase of well operations. Injection flow is depicted as arrows 136 in flow control component 132 and as arrows 138 in flow control component 134. As illustrated, injection fluid 138 passes through a converging nozzle 140 into a sudden enlargement that has an axial annular cup 142 wherein the fluid separates at nozzle throat and enters annular cup 142 that directs fluid back toward incoming flow. The fluid must then turn again to pass annular cup 142 and enter a sudden enlargement region 144. Consequently, injection fluid passing through flow control component 134 encounters significant resistance which results in a significant reduction in the injection flowrate therethrough. At the same time, injection fluid 136 passes through region 146, around annular cup 148 and through the throat into a diffuser of nozzle 150 with minimum losses. Consequently, injection fluid passing through flow control component 132 encounters little resistance and passes therethrough relatively unimpeded enabling a much higher injection flowrate as compared to the injection flowrate through flow control component 134.

FIG. 4B represents a production phase of well operations. Production flow is depicted as arrows 152 in flow control component 132 and as arrows 154 in flow control component 134. As illustrated, production fluid 152 passes through converging nozzle 150 into the sudden enlargement with axial annular cup 148 wherein the fluid separates at the nozzle throat and enters annular cup 148 that directs fluid back toward incoming flow. The fluid must then turn again to pass annular cup 148 and enter sudden enlargement region 146. Consequently, production fluid passing through flow control component 132 encounters significant resistance which results in a significant reduction in the production flowrate therethrough. At the same time, production fluid 154 passes through region 144, around annular cup 142 and through the throat into a diffuser of nozzle 140 with minimum losses. Consequently, production fluid passing through flow control component 134 encounters little resistance and passes therethrough relatively unimpeded enabling a much higher production flowrate as compared to the production flowrate through flow control component 132.

Figure 5A:
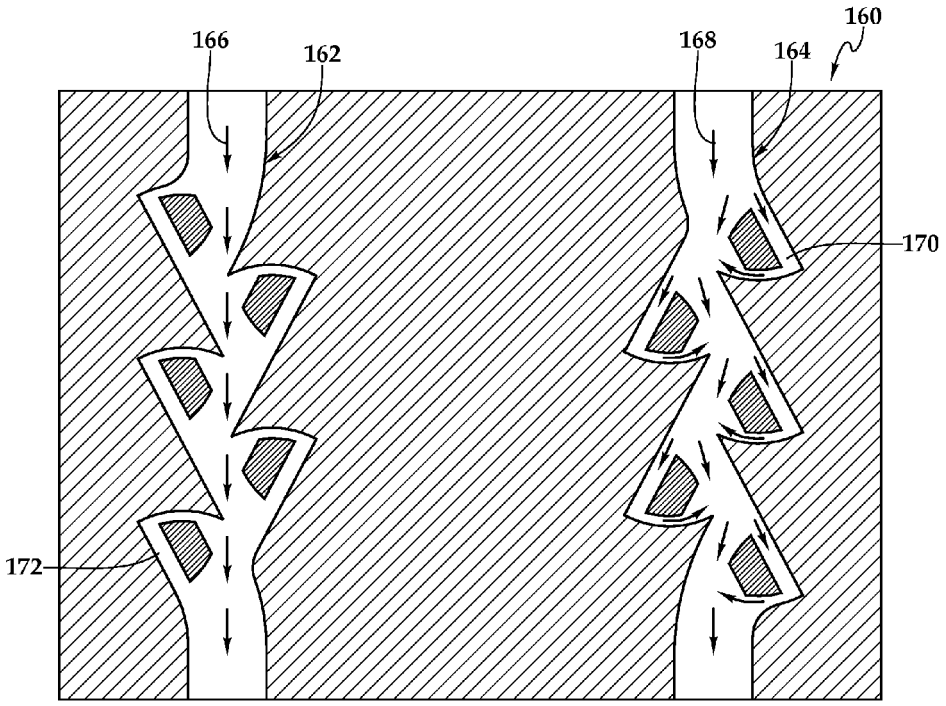
FIGS. 5A-5B are schematic illustrations of flow control components having directional dependent flow resistance for use in a fluid flow control system according to an embodiment of the present invention.
Figure 5B:
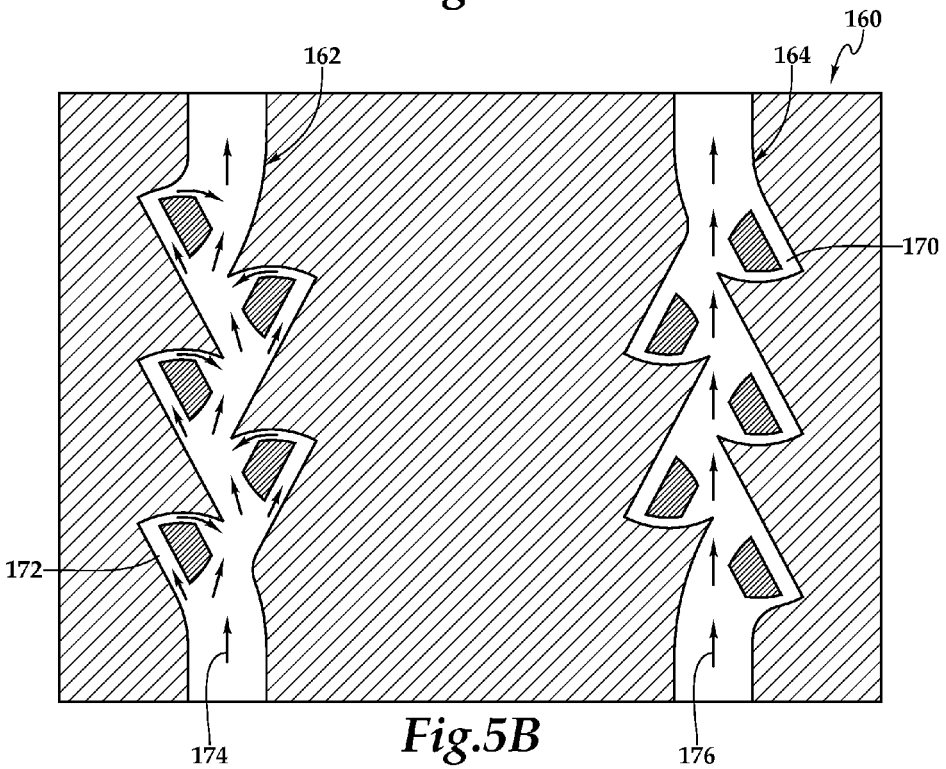

In another example, as depicted in FIGS. 5A-5B, a fluid flow control system 160 has two opposing flow control components 162, 164 having fluid diodes in the form of tesla diodes that provide direction dependent flow resistance. In the illustrated embodiment, flow control component 162 is an injection flow control component and flow control component 164 is a production flow control component. FIG. 5A represents an injection phase of well operations. Injection flow is depicted as arrows 166 in flow control component 162 and as arrows 168 in flow control component 164. As illustrated, injection fluid 168 passes through a series of connected branches and flow loops, such as loop 170, that cause the fluid to be directed back toward forward flow. Consequently, injection fluid passing through flow control component 164 encounters significant resistance which results in a significant reduction in the injection flowrate therethrough. At the same time, injection fluid 166 passes through the tesla diode without significant flow in the flow loops, such as loop 172. Consequently, injection fluid passing through flow control component 162 encounters little resistance and passes therethrough relatively unimpeded enabling a much higher injection flowrate as compared to the injection flowrate through flow control component 164.

FIG. 5B represents a production phase of well operations. Production flow is depicted as arrows 174 in flow control component 162 and as arrows 176 in flow control component 164. As illustrated, production fluid 174 passes through the series of connected branches and flow loops, such as loop 172, that cause the fluid to be directed back toward forward flow. Consequently, production fluid passing through flow control component 162 encounters significant resistance which results in a significant reduction in the production flowrate therethrough. At the same time, injection fluid 176 passes through the tesla diode without significant flow in the flow loops, such as loop 170. Consequently, production fluid passing through flow control component 164 encounters little resistance and passes therethrough relatively unimpeded enabling a much higher production flowrate as compared to the production flowrate through flow control component 162.

Figures 6A, 6B, 7A, 7B:
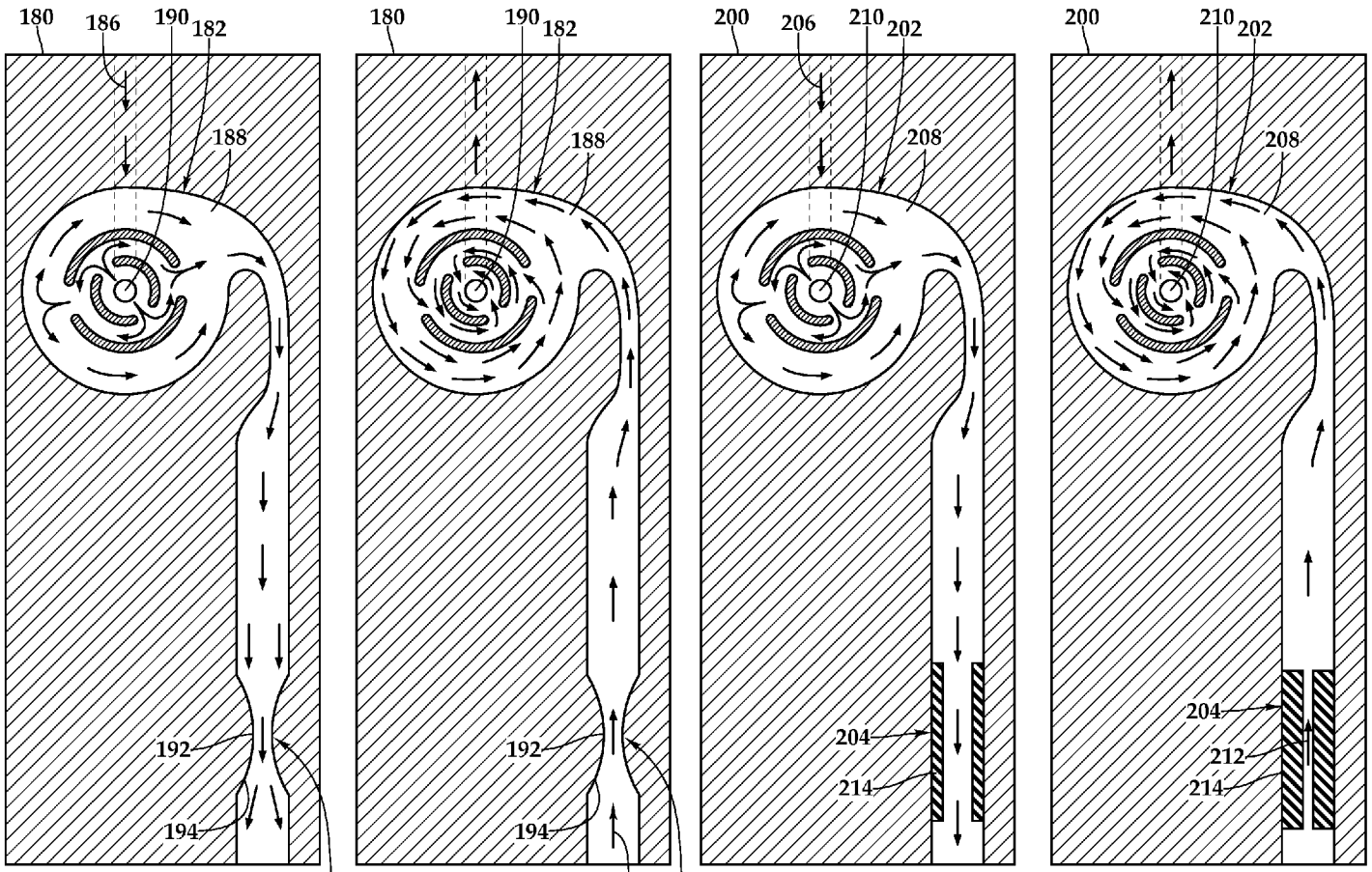
FIGS. 6A-6B are schematic illustrations of a two stage flow control component having two flow control elements in series and having directional dependent flow resistance for use in a fluid flow control system according to an embodiment of the present invention.
FIGS. 7A-7B are schematic illustrations of a two stage flow control component having two flow control elements in series and having directional dependent flow resistance for use in a fluid flow control system according to an embodiment of the present invention.

Even though the flow control components of the present have been described and depicted herein as single stage flow control components, it should be understood by those skilled in the art that flow control components of the present invention could have multiple flow control elements including at least one fluid diode that creates direction dependent flow resistance. For example, as depicted in FIGS. 6A-6B, a two stage flow control component 180 is depicted in injection and production operations, respectively, that may be used to replace a single stage flow control component in a fluid flow control system described above. Flow control component 180 may preferably be an injection flow control component capable of generating critical flow of steam during, for example, a cyclic steam stimulation operation. Flow control component 180 includes a first flow control element 182 in the form of a fluid diode and namely a vortex diode in series with a second flow control element 184 in the form of a converging/diverging nozzle.

During injection operations, as depicted in FIG. 6A, injection fluid 186 entering vortex chamber 188 from central port 190 primarily travels in a radial direction within vortex chamber 188, as indicted by the arrows. Injection fluid 186 exits vortex chamber 188 with little spiraling and without experiencing the associated frictional and centrifugal losses. Injection fluid 186 then enters nozzle 184 that has a throat portion 192 and diffuser portion 194. As injection fluid 186 approaches throat portion 192 its velocity increases and its pressure decreases. In throat portion 192 injection fluid 186 reaches sonic velocity and therefore critical flow under the proper upstream and downstream pressure regimes.

During production operations, as depicted in FIG. 6B, production fluid 196 enters flow control component 180 and pass through nozzle 184 with little resistance. Production fluid 196 is then directed into vortex chamber 188 primarily in a tangentially direction which causes the fluid to spiral around vortex chamber 188, as indicted by the arrows, before eventually exiting through central port 190. Fluid spiraling around vortex chamber 188 suffers from frictional and centrifugal losses. Consequently, production fluid passing through flow control component 180 encounters significant resistance which results in a significant reduction in the production flowrate therethrough.

As another example, depicted in FIGS. 7A-7B, a two stage flow control component 200 is depicted in injection and production operations, respectively, that may be used to replace a single stage flow control component in a fluid flow control system described above. Flow control component 200 may preferably be an injection flow control component capable of substantially shutting off flow of an undesired fluid, for example, a hydrocarbon fluid during production operation. Flow control component 200 includes a first flow control element 202 in the form of a fluid diode and namely a vortex diode in series with a second flow control element 204 in the form of a fluid selector valve.

During injection operations, as depicted in FIG. 7A, injection fluid 206 entering vortex chamber 208 from central port 210 primarily travels in a radial direction within vortex chamber 208, as indicted by the arrows. Injection fluid 206 exits vortex chamber 208 with little spiraling and without experiencing the associated frictional and centrifugal losses. Injection fluid 206 then passes through fluid selector valve 204 with minimal resistance. During production operations, as depicted in FIG. 7B, production fluid 212 enters flow control component 200 and encounter fluid selector valve 204. In the illustrated embodiment, fluid selector valve 204 includes a material 214, such as a polymer, that swells when it comes in contact with hydrocarbons. As such, fluid selector valve 204 closes or substantially closes the fluid path through flow control component 200. Any production fluid 212 that passes through fluid selector valve 204 is then directed into vortex chamber 208 primarily in a tangentially direction which causes the fluid to spiral around vortex chamber 208, as indicted by the arrows, before eventually exiting through central port 210. Together, vortex chamber 208 and fluid selector valve 204 provide significant resistance to production therethrough.

Figure 8:
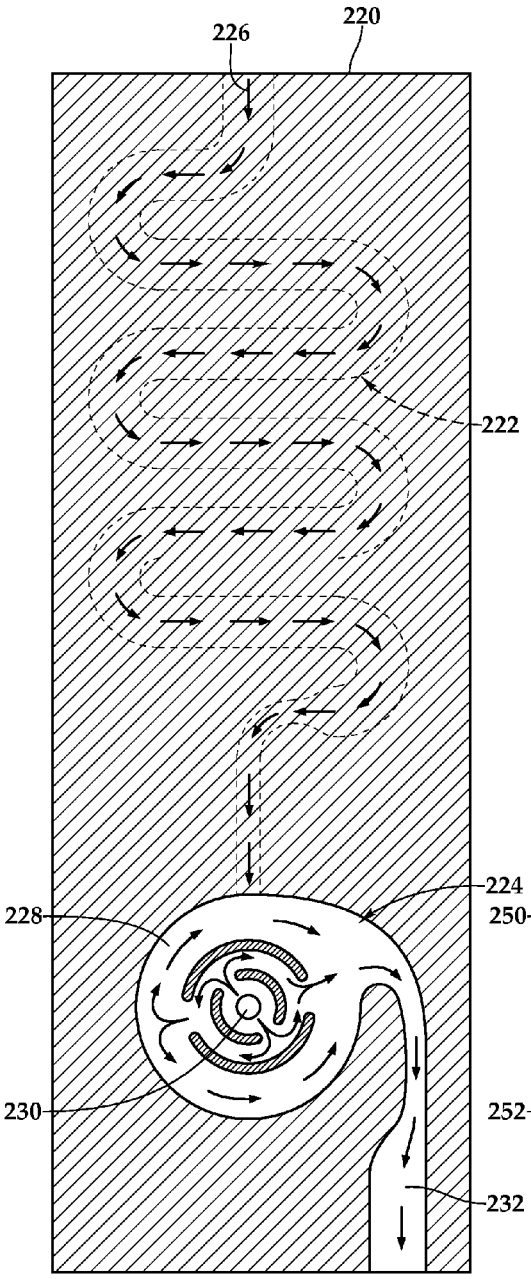
FIG. 8 is a schematic illustration of a two stage flow control component having two flow control elements in series and having directional dependent flow resistance for use in a fluid flow control system according to an embodiment of the present invention.

FIG. 8 depicts a two stage flow control component 220 during production operations that may be used to replace a single stage flow control component in a fluid flow control system described above. Flow control component 220 may preferably be a production flow control component. Flow control component 220 includes a first flow control element 222 in the form of an inflow control device and namely a torturous path in series with a second flow control element 224 in the form of a vortex diode. During production operations, production fluid 226 enters flow control component 220 and encounter torturous path 222 which serves as the primary flow regulator of production flow. Production fluid 226 is then directed into vortex chamber 228 from central port 230 primarily in a radial direction, as indicted by the arrows, with little spiraling and without experiencing the associated frictional and centrifugal losses, before exit flow control component 220 through lateral port 232. During injection operations (not pictured), injection fluid would enter vortex chamber 228 primarily in a tangentially direction which causes the fluid to spiral around vortex chamber 228 before eventually exiting through central port 230. The injection fluid would then travel through torturous path 222. Together, vortex chamber 228 and torturous path 222 provide significant resistance to injection flow therethrough.

Figure 9:
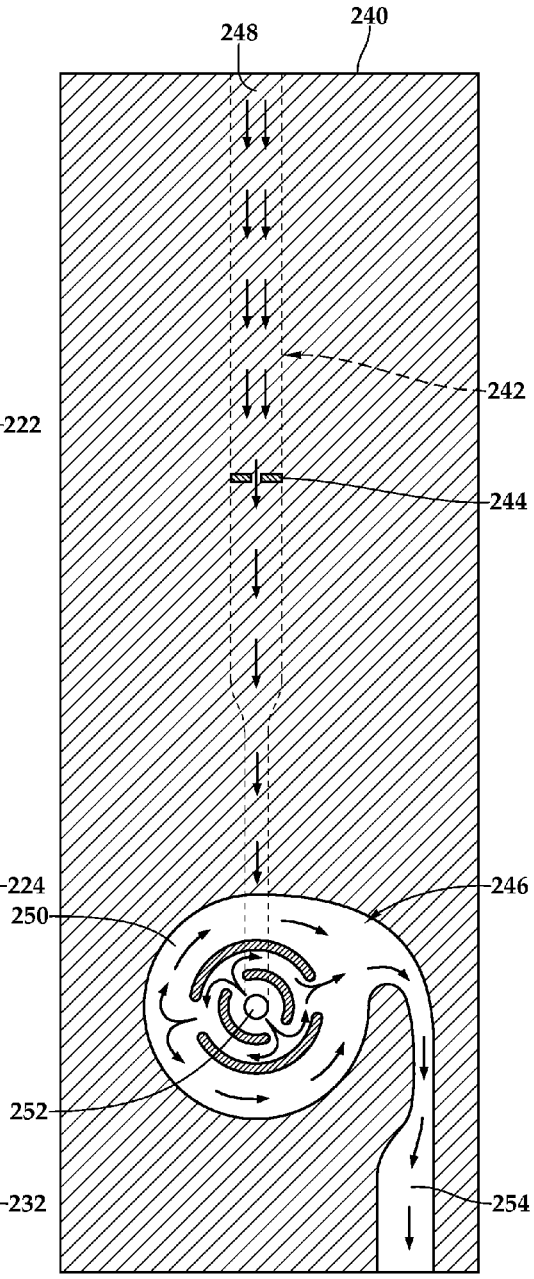
FIG. 9 is a schematic illustration of a two stage flow control component having two flow control elements in series and having directional dependent flow resistance for use in a fluid flow control system according to an embodiment of the present invention.

FIG. 9 depicts a two stage flow control component 240 during production operations that may be used to replace a single stage flow control component in a fluid flow control system described above. Flow control component 240 may preferably be a production flow control component. Flow control component 240 includes a first flow control element 242 in the form of an inflow control device and namely an orifice 244 in series with a second flow control element 246 in the form of a vortex diode. During production operations, production fluid 248 enters flow control component 240 and orifice 244 which serves as the primary flow regulator of production flow. Production fluid 248 is then directed into vortex chamber 250 from central port 252 primarily in a radial direction, as indicted by the arrows, with little spiraling and without experiencing the associated frictional and centrifugal losses, before exit flow control component 240 through lateral port 254. During injection operations (not pictured), injection fluid would enter vortex chamber 250 primarily in a tangentially direction which causes the fluid to spiral around vortex chamber 250 before eventually exiting through central port 252. The injection fluid would then travel through orifice 244. Together, vortex chamber 250 and orifice 244 provide significant resistance to injection flow therethrough.

Even though FIGS. 8-9 have described and depicted particular inflow control devices in a two stage flow control component for use in a fluid flow control system of the present invention, it should be understood by those skilled in the art that other types of inflow control devices may be used in a two stage flow control component for use in a fluid flow control system of the present invention. Also, even though FIGS. 6A-9 have described and depicted two stage flow control components for use in a fluid flow control system of the present invention, it should be understood by those skilled in the art that flow control components having other numbers of stages are possible and are considered within the scope of the present invention.

Figure 10A:
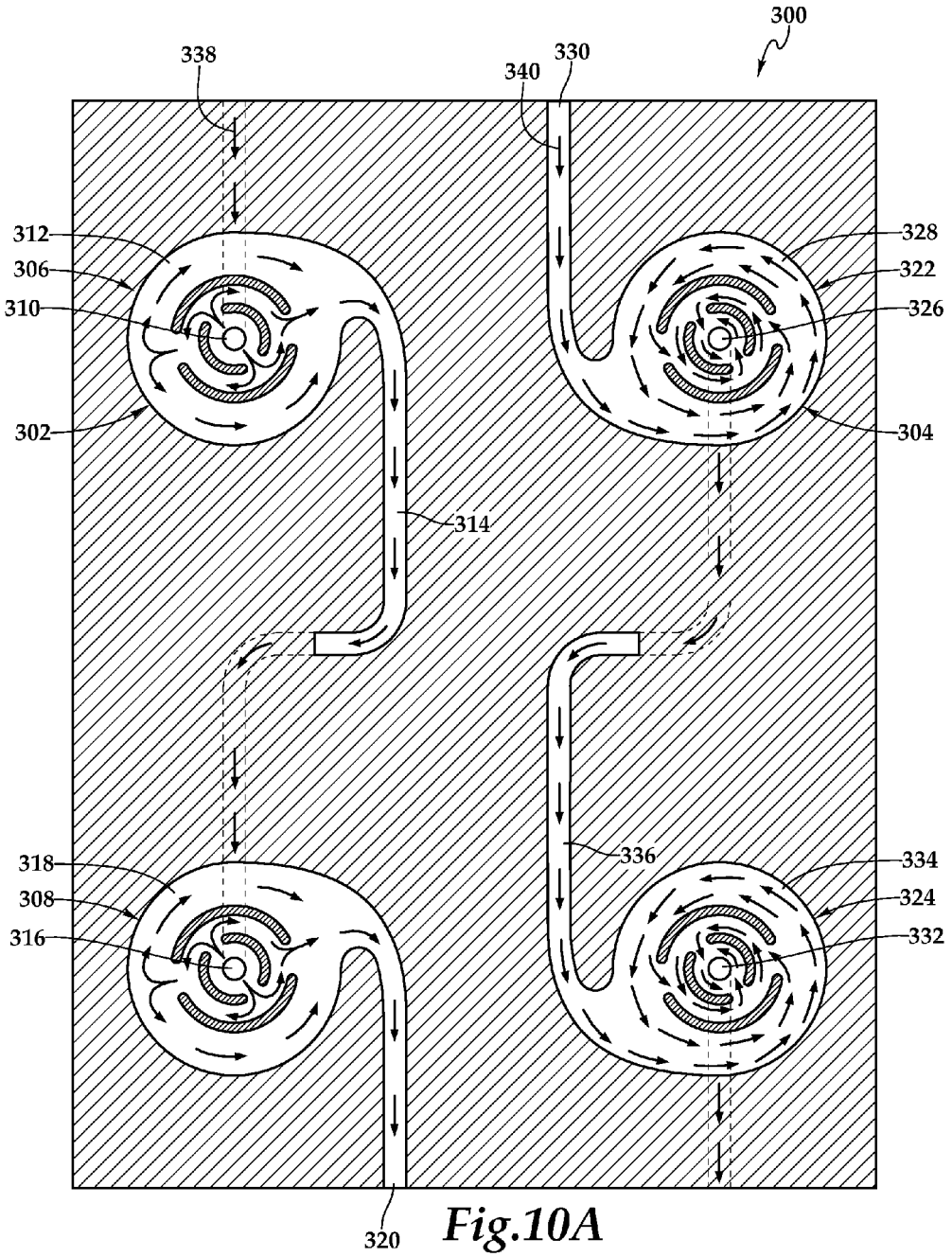
FIGS. 10A-10B are schematic illustrations of two stage flow control components having directional dependent flow resistance for use in a fluid flow control system according to an embodiment of the present invention.
Figure 10B:
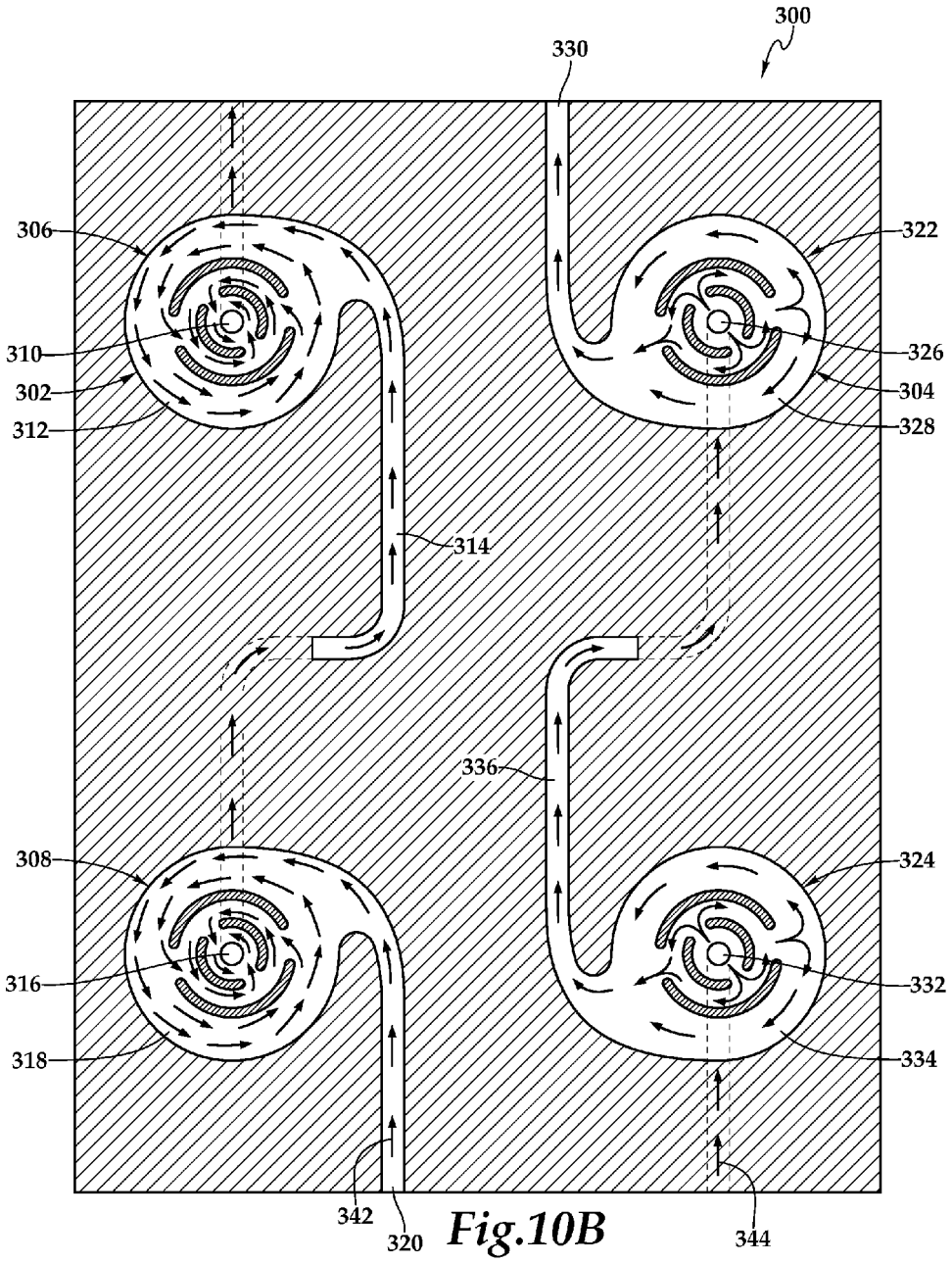

Referring next to FIGS. 10A-10B, therein is depicted a portion of a fluid flow control system having two stage flow control components with directional dependent flow resistance, during injection and production operations, respectively, that is generally designated 300. In the illustrated section, two opposing two stage flow control components 302, 304 are depicted wherein flow control component 302 is an injection flow control component and flow control component 304 is a production flow control component. As illustrated, flow control component 302 includes two fluid diodes in the form of vortex diodes 306, 308 in series with one another. Vortex diode 306 has a central port 310, a vortex chamber 312 and a lateral port 314. Vortex diode 308 has a central port 316, a vortex chamber 318 and a lateral port 320. Likewise, flow control component 304 includes two fluid diodes in the form of vortex diodes 322, 324 in series with one another. Vortex diode 322 has a central port 326, a vortex chamber 328 and a lateral port 330. Vortex diode 324 has a central port 332, a vortex chamber 334 and a lateral port 336.

FIG. 10A represents an injection phase of well operations. Injection flow is depicted as arrows 338 in flow control component 302 and as arrows 340 in flow control component 304. As illustrated, injection fluid 340 entering flow control component 304 at lateral port 330 is directed into vortex chamber 328 primarily in a tangentially direction which causes the fluid to spiral around vortex chamber 328, as indicted by the arrows, before eventually exiting through central port 326. Injection fluid 340 is then directed into vortex chamber 334 primarily in a tangentially direction which causes the fluid to spiral around vortex chamber 334, as indicted by the arrows, before eventually exiting through central port 332. Injection fluid 340 suffers from frictional and centrifugal losses passing through flow control component 304. Consequently, injection fluid passing through flow control component 304 encounters significant resistance which results in a significant reduction in the injection flowrate therethrough.

At the same time, injection fluid 338 entering vortex chamber 312 from central port 310 primarily travels in a radial direction within vortex chamber 312, as indicted by the arrows, before exiting through lateral port 314 with little spiraling within vortex chamber 312 and without experiencing the associated frictional and centrifugal losses. Injection fluid 338 then enters vortex chamber 318 from central port 316 primarily traveling in a radial direction within vortex chamber 318, as indicted by the arrows, before exiting through lateral port 320 with little spiraling within vortex chamber 318 and without experiencing the associated frictional and centrifugal losses. Consequently, injection fluid passing through flow control component 302 encounters little resistance and passes therethrough relatively unimpeded enabling a much higher injection flowrate as compared to the injection flowrate through flow control component 304.

FIG. 10B represents a production phase of well operations. Production flow is depicted as arrows 342 in flow control component 302 and as arrows 344 in flow control component 304. As illustrated, production fluid 342 entering flow control component 302 at lateral port 320 is directed into vortex chamber 318 primarily in a tangentially direction which causes the fluid to spiral around vortex chamber 318, as indicted by the arrows, before eventually exiting through central port 316. Production fluid 342 is then directed into vortex chamber 312 primarily in a tangentially direction which causes the fluid to spiral around vortex chamber 312, as indicted by the arrows, before eventually exiting through central port 310. Fluid spiraling around vortex chambers 312, 318 suffers from frictional and centrifugal losses. Consequently, production fluid passing through flow control component 302 encounters significant resistance which results in a significant reduction in the production flowrate therethrough.

At the same time, production fluid 344 entering vortex chamber 334 from central port 332 primarily travels in a radial direction within vortex chamber 334, as indicted by the arrows, before exiting through lateral port 336 with little spiraling within vortex chamber 334 and without experiencing the associated frictional and centrifugal losses. Production fluid 344 then enters vortex chamber 328 from central port 326 primarily traveling in a radial direction within vortex chamber 328, as indicted by the arrows, before exiting through lateral port 330 with little spiraling within vortex chamber 328 and without experiencing the associated frictional and centrifugal losses. Consequently, production fluid passing through flow control component 304 encounters little resistance and passes therethrough relatively unimpeded enabling a much higher production flowrate as compared to the production flowrate through flow control component 302.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A bidirectional downhole fluid flow control system comprising:

a plurality of injection flow control components having direction dependent flow resistance, the injection flow control components further comprising two stage flow control components including, in series, a first vortex diode stage and a second vortex diode stage, each of the first and second stages of the injection flow control components having a central inlet port and a radial outlet port, wherein the radial outlet port of the first stage is in fluid communication with the central inlet port of the second stage of the injection flow control components; and a plurality of production flow control components having direction dependent flow resistance, the production flow control components further comprising two stage flow control components including, in series, a first vortex diode stage and a second vortex diode stage, each of the first and second stages of the production flow control components having a central outlet port and a radial inlet port, wherein the central outlet port of the first stage is in fluid communication with the radial inlet port of the second stage of the production flow control components, wherein, the production flow control components are in parallel with the injection flow control components;

wherein, injection fluid flow experiences a greater flow resistance through the production flow control components than through the injection flow control components; and wherein, production fluid flow experiences a greater flow resistance through the injection flow control components than through the production flow control components.

2. The flow control system as recited in claim 1 wherein injection fluid flow entering the vortex diodes of the injection flow control components travels primarily in a radial direction and wherein production fluid flow entering the vortex diodes of the injection flow control components travels primarily in a tangential direction.

3. The flow control system as recited in claim 1 wherein production fluid flow entering the vortex diodes of the production flow control components travels primarily in a radial direction and wherein injection fluid flow entering the vortex diodes of the production flow control components travels primarily in a tangential direction.

4. An enhanced oil recovery method comprising:

positioning a completion string including a bidirectional fluid flow control system at a target location in a wellbore, the control system having a plurality of solid state injection flow control components with direction dependent flow resistance in parallel with a plurality of solid state production flow control components with direction dependent flow resistance, the injection flow control components further comprising two stage flow control components including, in series, a first vortex diode stage and a second vortex diode stage, each of the first and second stages of the injection flow control components having a central port and a radial port, wherein the radial port of the first stage is in fluid communication with the central port of the second stage of the injection flow control components, the production flow control components further comprising two stage flow control components including, in series, a first vortex diode stage and a second vortex diode stage, each of the first and second stages of the production flow control components having a central port and a radial port, wherein the central port of the first stage is in fluid communication with the radial port of the second stage of the production flow control components;

injecting steam from the surface into a formation through the bidirectional fluid flow control system by introducing steam to both the central port of the first stage of the injection flow control components and to the radial port of the first stage of the production flow control components, wherein the bidirectional fluid flow control system allows a greater volume of steam to pass through the injection flow control components than through the production flow control components;

transferring heat from the steam into fluid in the formation; and producing the fluid from the formation to the surface through the bidirectional fluid flow control system by introducing the formation fluid to both the radial port of the second stage of the injection flow control components and to the central port of the second stage of the production flow control components, wherein the bidirectional fluid flow control system allows a greater volume of the fluid to pass through the production flow control components than through the injection flow control components.

5. The method as recited in claim 4 wherein injecting steam from the surface into the formation through the bidirectional fluid flow control system such that a greater volume of steam passes through the injection flow control components than through the production flow control components further comprises injecting a first portion of the steam into the formation from the injection flow control components and injecting a second portion of the steam into the formation from the production flow control components, wherein the first portion of the steam injected into the formation is greater than the second portion of the steam injected into the formation.

6. The method as recited in claim 5 wherein producing the fluid from the formation to the surface through the bidirectional fluid flow control system such a greater volume of the fluid passes through the production flow control components than through the injection flow control components further comprises producing a first portion of the fluid into a tubing string from the production flow control components and producing a second portion of the fluid into a tubing string from the injection flow control components, wherein the first portion of the fluid flowing into the tubing string is greater than the second portion of the fluid flowing into the tubing string.

7. A multizone enhanced oil recovery method comprising:

positioning a completion string at a target location in a wellbore, the completion string including a bidirectional fluid flow control system for a plurality of zones in the wellbore, each bidirectional fluid flow control systems having a plurality of solid state injection flow control components with direction dependent flow resistance in parallel with a plurality of solid state production flow control components with direction dependent flow resistance, the injection flow control components further comprising two stage flow control components including, in series, a first vortex diode stage and a second vortex diode stage, each of the first and second stages of the infection flow control components having a central port and a radial port, wherein the radial port of the first stage is in fluid communication with the central port of the second stage of the injection flow control components, the production flow control components further comprising two stage flow control components including, in series, a first vortex diode stage and a second vortex diode stage, each of the first and second stages of the production flow control components having a central port and a radial port, wherein the central port of the first stage is in fluid communication with the radial port of the second stage of the production flow control components;

injecting steam from the surface into the plurality of zones through the bidirectional fluid flow control systems by introducing steam to both the central ports of the first stages of the injection flow control components and to the radial ports of the first stages of the production flow control components, wherein the bidirectional fluid flow control systems allow a greater volume of steam to pass through the injection flow control components than through the production flow control components;

transferring heat from the steam into fluid in formations associated with the zones; and producing the fluid from the formations to the surface through the bidirectional fluid flow control systems by introducing the formation fluid to both the radial ports of the second stages of the injection flow control components and to the central ports of the second stages of the production flow control components, wherein the bidirectional fluid flow control systems allow a greater volume of the fluid to pass through the production flow control components than through the injection flow control components.

8. The method as recited in claim 7 wherein each of the control systems includes a greater number of the injection flow control components than the production flow control components.

9. An enhanced oil recovery method comprising:

positioning a completion string including a bidirectional fluid flow control system at a target location in a wellbore, the control system having a plurality of solid state injection flow control components with direction dependent flow resistance in parallel with a plurality of solid state production flow control components with direction dependent flow resistance, the plurality of solid state injection flow control components being a greater number than the plurality of solid state production flow control components, the injection flow control components further comprising two stage flow control components including, in series, a first vortex diode stage and a second vortex diode stage, each of the first and second stages of the infection flow control components having a central port and a radial port, wherein the radial port of the first stage is in fluid communication with the central port of the second stage of the injection flow control components, the production flow control components further comprising two stage flow control components including, in series, a first vortex diode stage and a second vortex diode stage, each of the first and second stages of the production flow control components having a central port and a radial port, wherein the central port of the first stage is in fluid communication with the radial port of the second stage of the production flow control components;

injecting steam from the surface into a formation through the bidirectional fluid flow control system by introducing steam to both the central ports of the first stages of the injection flow control components and to the radial ports of the first stages of the production flow control components, wherein the bidirectional fluid flow control system allows a greater volume of steam to pass through the injection flow control components than through the production flow control components;

transferring heat from the steam into fluid in the formation; and producing the fluid from the formation to the surface through the bidirectional fluid flow control system by introducing the formation fluid to both the radial ports of the second stages of the injection flow control components and to the central ports of the second stages of the production flow control components, wherein the bidirectional fluid flow control system allows a greater volume of the fluid to pass through the production flow control components than through the injection flow control components.

* * * * *